US011448169B2

(12) United States Patent
Lee et al.

(10) Patent No.: US 11,448,169 B2
(45) Date of Patent: Sep. 20, 2022

(54) VEHICLE EXHAUST GAS RECIRCULATION COOLER

(71) Applicant: Hanon Systems, Daejeon (KR)

(72) Inventors: Sang Jun Lee, Daejeon (KR); Tae Soo Chun, Daejeon (KR); Taek-Keun Kim, Daejeon (KR)

(73) Assignee: Hanon Systems, Daejeon (KR)

( * ) Notice: Subject to any disclaimer, the term of this patent is extended or adjusted under 35 U.S.C. 154(b) by 165 days.

(21) Appl. No.: 16/475,582

(22) PCT Filed: Feb. 22, 2018

(86) PCT No.: PCT/KR2018/002154
§ 371 (c)(1),
(2) Date: Jul. 2, 2019

(87) PCT Pub. No.: WO2018/155914
PCT Pub. Date: Aug. 30, 2018

(65) Prior Publication Data

US 2021/0131386 A1 May 6, 2021

(30) Foreign Application Priority Data

Feb. 24, 2017 (KR) ..... 10-2017-0024813

(51) Int. Cl.
*F02M 26/32* (2016.01)
*F28D 21/00* (2006.01)
*F02M 26/30* (2016.01)

(52) U.S. Cl.
CPC ..... *F02M 26/32* (2016.02); *F02M 26/30* (2016.02); *F28D 2021/008* (2013.01)

(58) Field of Classification Search
CPC ..... F02M 26/32; F02M 26/28; F02M 26/30; F28D 2021/008; F28D 21/0003
See application file for complete search history.

(56) References Cited

U.S. PATENT DOCUMENTS 6,460,520 B1 * 10/2002 Challis ..... F28D 7/16 123/41.01
7,661,415 B2 * 2/2010 Nakamura ..... F28D 9/0025 123/568.12
9,856,831 B2 * 1/2018 Yang ..... F02M 26/30
10,151,279 B2 * 12/2018 Kim ..... F02M 26/24
10,495,036 B2 * 12/2019 Kim ..... F02M 26/32
(Continued)

FOREIGN PATENT DOCUMENTS

CN 107614860 A 1/2018
JP 2007-292012 A 11/2007
(Continued)

OTHER PUBLICATIONS

International Search Report issued in PCT/KR2018/002154 dated May 31, 2018.

*Primary Examiner* — Gonzalo Laguarda
(74) *Attorney, Agent, or Firm* — Norton Rose Fulbright US LLP; James R. Crawford

(57) ABSTRACT

The present invention relates to a vehicle EGR cooler for cooling down recirculation exhaust gas of a vehicle engine and, more particularly, to a vehicle EGR cooler, which is inserted into an engine block, and facilitates diameter adjustment and design change of a coolant outlet since a coolant outlet side is provided on an outer side of the engine block.

13 Claims, 9 Drawing Sheets

(56) References Cited

U.S. PATENT DOCUMENTS

| | | | | |
|---|---|---|---|---|
| 2009/0014151 | A1* | 1/2009 | Capelle | F02M 26/32<br>165/44 |
| 2017/0218888 | A1* | 8/2017 | Ohrem | F02M 26/31 |
| 2017/0370329 | A1* | 12/2017 | Chun | F28F 1/02 |
| 2020/0102917 | A1* | 4/2020 | Son | F02M 26/32 |

FOREIGN PATENT DOCUMENTS

| | | | |
|---|---|---|---|
| KR | 100748756 | B1 | 8/2007 |
| KR | 100814073 | B1 | 3/2008 |
| KR | 201 10105361 | A | 9/2011 |
| KR | 101480633 | B1 | 1/2015 |
| KR | 20170011151 | A | 2/2017 |

* cited by examiner

VEHICLE EXHAUST GAS RECIRCULATION COOLER

This patent application is a national phase under 35 U.S.C. § 371 of International Application No. PCT/KR2018/002154 filed Feb. 22, 2018, which claims priority from Korean Patent Application No. 10-2017-0024813, filed Feb. 24, 2017, each of which is hereby incorporated herein by reference in its entirety for all purposes.

TECHNICAL FIELD

The present invention relates to a vehicle exhaust gas recirculation (EGR) cooler for cooling a recirculated exhaust gas of a vehicle engine, and more particularly, to a vehicle EGR cooler inserted into an engine block, in which an outlet for a coolant is provided outside the engine block, thus facilitating an adjustment of a diameter of the outlet and a change in a design thereof.

BACKGROUND ART

Generally, exhaust gases of automobiles contain a large amount of harmful substances such as carbon monoxide, nitrogen oxides, hydrocarbons, and the like. In particular, the emission amount of harmful substances such as nitrogen oxides increase as a temperature of an engine increases.

Today, exhaust gas regulations are strengthened in each country. In order to satisfy exhaust strengthened gas regulations for each country, various devices are installed in a vehicle to reduce harmful substances such as nitrogen oxides in the exhaust gas.

In particular, components of burned fuel of vehicles equipped with a diesel engine are different from those of vehicles equipped with a gasoline engine, and thus, a device such as a diesel particulate filter (DPF) or an exhaust gas recirculation (EGR) is installed in such vehicles equipped with a diesel engine to reduce harmful exhaust gases such as nitrogen oxides to satisfy exhaust gas regulations.

Generally, the DPF collects particulate matters (PM) contained in exhaust gases and jets fuel into an exhaust pipe at a front end of the filter to forcibly burn the particulate matters, thus reducing an outflow gas and regenerating the filter.

The EGR serves to intake a portion of an exhaust gas of a vehicle together with a mixer to lower a temperature of a combustion chamber to reduce an outflow of harmful substances such as nitrogen oxides and sulfur oxides.

In addition, today, EGR coolers are applied together to lower a temperature of an EGR gas due to strengthened regulations regarding pollution of the atmospheric environment worldwide. The exhaust gas flowing into the EGR cooler is cooled by a coolant (cooling fluid) flowing out through the engine.

Related arts thereof include Korean Patent No. 0748756 (Title: EGR cooler of EGR system for vehicle, Registration Date: Aug. 6, 2007).

The related art EGR cooler includes a cooler body having a coolant inflow pipe and a coolant outflow pipe at opposing ends thereof and a plurality of gas tubes arranged in parallel in a length direction inside the cooler body, and a lead valve is provided on one side of the cooler body.

Therefore, an exhaust gas having a high temperature may be cooled by a circulation system in which a coolant supplied through the coolant inflow pipe is heat-exchanged with an exhaust gas flowing inside the gas tubes in the interior of the cooler body and the heat-exchanged coolant flows out through the coolant outflow pipe.

Here, in the case of an engine block insertion-type EGR cooler, a cooler body is inserted inside an engine block to receive a coolant flowing inside the engine block to cool an exhaust gas and allow the coolant to flow out again into the engine block. The engine block insertion-type EGR cooler having the above configuration includes both a coolant inflow pipe and a coolant outflow pipe provided inside the engine block, and in this case, the following problems arise.

First, it is not easy to change a design of an engine block package due to the coolant inflow pipe and the coolant outflow pipe.

Second, when an engine block layout is changed, a design of the coolant inflow pipe and the coolant outflow pipe are required to be changed, unnecessarily increasing cost.

Third, since shapes of the coolant inflow pipe and the coolant outflow pipe are restricted and are not easily changed, coolant flow is limited and heat exchange performance deteriorates due to pressure drop of the coolant.

Fourth, if pressure drop of the coolant occurs and the heat exchange performance deteriorates as mentioned above, engine power may be reduced due to degraded exhaust gas cooling performance.

DISCLOSURE

Technical Problem

An object of the present invention is to provide a vehicle EGR cooler in which a coolant outflow pipe of a cooler body is provided on an outer side of an engine block through a plate through which an exhaust gas flows in and out, thus facilitating adjustment of a diameter of a coolant outlet and change in a design thereof.

Technical Solution

In one general aspect, a vehicle exhaust gas recirculation (EGR) cooler includes: a housing 100 provided in a cylinder block 10 located outside a water jacket 11 of an internal combustion engine mounted in a vehicle and including a cooling fluid inlet 110 and a cooling fluid outlet 120; a single or a plurality of gas tubes 200, 250, 260 disposed inside the housing 100 and configuring an exhaust gas flow path; a tube plate 300 including tube insertion holes 310 to which opposing ends of the gas tubes 200, 250, 260 are inserted and fixed; and a gas cover 400 coupled to the housing 100 on an outer side of the tube plate 300 and having an exhaust gas inlet 10 connected to one end of the gas tube 200 and an exhaust gas outlet 420 connected to the other end of the gas tube 200.

Here, the cooling fluid inlet 110 may be provided adjacent to the cylinder block 10, and the cooling fluid outlet 120 may be provided outside the cylinder block 10.

Also, the cooling fluid outlet 120 may be provided outside the cylinder block 10 through the tube plate 300 and the gas cover 400.

Also, the cooling fluid outlet 120 may include a first outlet hole 121 provided at the tube plate 300; a second outlet 122 provided at the gas cover 400 to correspond to the first outlet hole 121; and an outflow pipe 125 connected to the second outlet hole 122 at one end thereof.

Also, the first and second outlet holes 121 and 122 may be provided close to any one of the tube insertion holes 310.

The first and second outlet holes 121 and 122 may be provided close to the exhaust outlet 420.

The gas tube 250 may include a plurality of rows 251, 252, 253, 254 arranged and spaced apart from each other in a width direction of the tube plate, and the tube of each row 251, 252, 253, 254 has multiple steps.

Also, the gas tube 250 may be configured such that the number of steps of the tubes 251, 254 in at least one row disposed on an outermost side is smaller than the number of steps of the tubes 252, 253 in a neighboring row.

Also, the gas tube 260 may be configured such that a plurality of rows 261, 262, 263 are arranged and spaced apart from each other in a width direction of the tube plate 300 and diagonally arranged in the width direction of the tube plate 300.

Also, the vehicle EGR cooler 1 may further include: a sealing member 600 provided between the tube plate 300 and the gas cover 400.

Also, the sealing member 600 may be provided between the tube plate 300 in which the first and second outlet holes 121 and 122 and the tube insertion hole 310 are provided and the gas cover 400.

In the vehicle EGR cooler 1, the tube plate 300, the sealing member 600, and the gas cover 400 may be coupled by a bolt.

Also, in the vehicle EGR cooler 1, the tube plate 300 and the gas cover 400 may be braze coupled.

Also, the housing 100 may be arranged to be in contact with an outer wall surface of the cylinder block 10 or may be integrally provided with the cylinder block 10.

The gas tube 200 may include: a flat portion 210 horizontally extending in a length direction of the housing 100; a first bent portion 220 bent from one end of the flat portion 210 to outside the housing 100; and a second bent portion 230 bent from the other end of the flat portion 210 to outside of the housing 100, wherein the first and second bent portions 230 are bent and rounded to have a predetermined curvature R at opposing ends of the flat portion 210.

Also, the tube plate 300 may include a cooling fluid guide portion 320 in which an inner side surface thereof at a position corresponding to the flat portion 210 protrudes toward the flat portion 210.

Advantageous Effects

According to the vehicle EGR cooler of the embodiment of the present invention configured as described above, it is possible to easily adjust a diameter of the coolant outflow pipe through which a coolant flows out or easily change a design thereof, and thus, the coolant outflow pipe may be easily replaced when an engine block package design is changed.

Further, since the design of the coolant inflow pipe and the coolant outflow pipe is not required to be changed when the engine block layout is changed, an unnecessary increase in cost may be prevented.

Further, since the shape of the coolant outflow pipe is easily changed, the outflow pipe may be designed to be optimized for coolant flow, and thus, a coolant may smoothly flow and heat-exchange performance may be improved.

In addition, since heat-exchange performance is improved, exhaust gas cooling performance is improved and engine power may be improved.

DESCRIPTION OF REFERENCE NUMERALS

| | |
|---|---|
| 1: EGR cooler | |
| 100: housing | 110: cooling fluid inlet |
| 120: cooling fluid outlet | 121: first outlet hole |
| 122: second outlet hole | 125: outflow pipe |
| 200: gas tube | |
| 300: tube plate | |
| 400: gas cover | 410: exhaust gas inlet |
| 420: exhaust gas outlet | |
| 500: gasket | |
| 600: sealing member | |

BEST MODE

Figure 1:
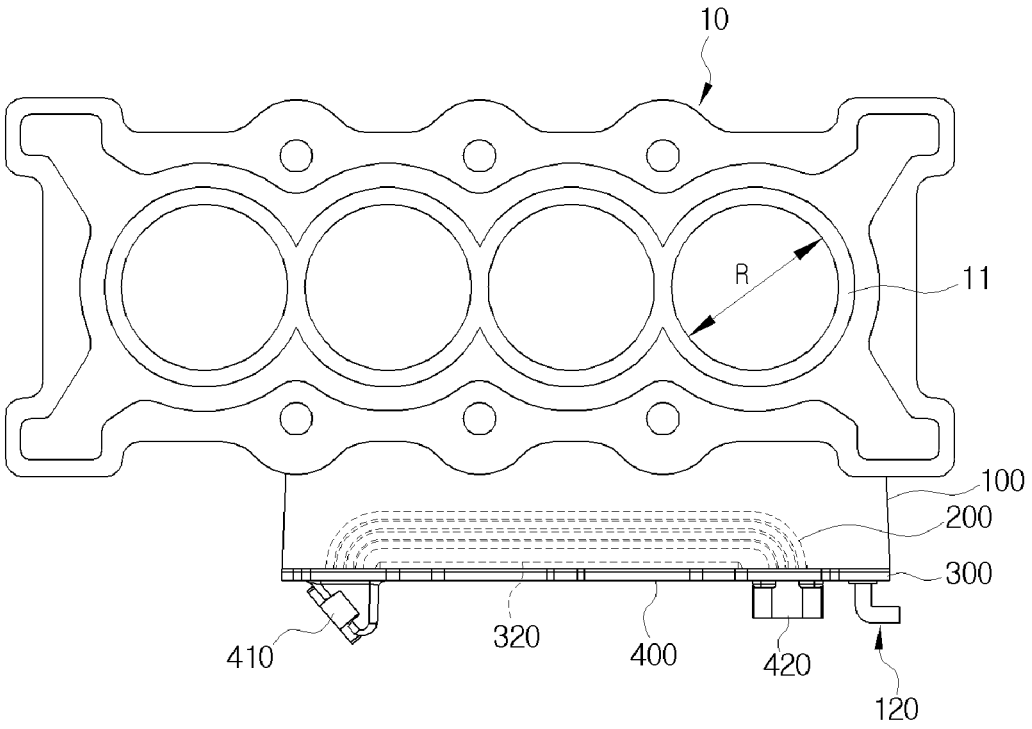
FIG. 1 is a front view illustrating a state in which an EGR cooler according to the present invention is mounted on an outer side of an engine cylinder.
Figure 2:
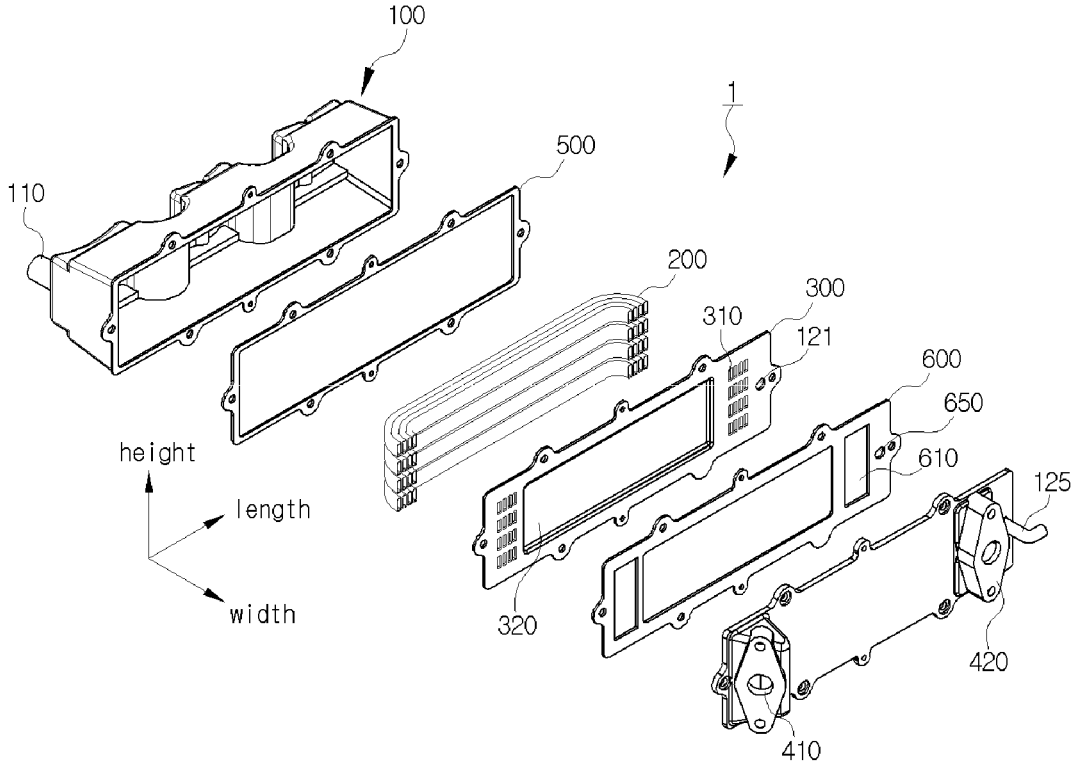
FIG. 2 is an exploded perspective view of an EGR cooler according to the present invention.
Figure 3:
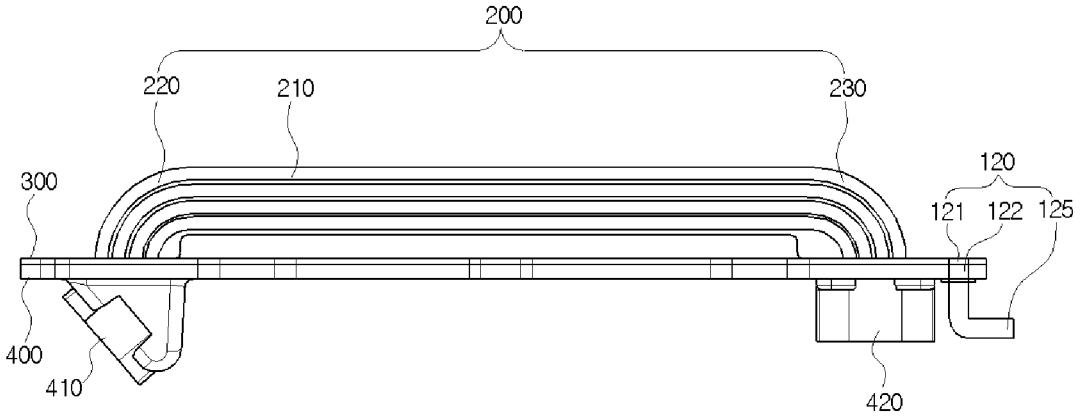
FIG. 3 is a front view illustrating a state in which a housing is removed from a vehicle EGR cooler according to the present invention.

FIG. 1 is a front view of a vehicle EGR cooler 1 according to an embodiment of the present invention and FIG. 2 is an exploded perspective view of the vehicle EGR cooler 1 according to an embodiment of the present invention. FIG. 3 is a front view illustrating a state in which a housing 100 is removed from the vehicle EGR cooler 1 according to an embodiment of the present invention.

As illustrated in FIGS. 1 and 2, the vehicle EGR cooler 1 according to the present invention includes a housing 100, gas tubes 200, a tube plate 300, and a gas cover 400.

The housing 100 includes a cooling fluid inlet 110 and a cooling fluid outlet 120, and a space for accommodating a cooling fluid flowing in through the cooling fluid inlet 110 is provided therein. Here, a coolant is generally used as the cooling fluid and may be replaced with any other cooling fluids.

As illustrated in FIG. 1, the housing 100 corresponds to an outer wall surface of a cylinder block 10 located outside a water jacket 11 of an internal combustion engine mounted on a vehicle and is in contact with the outer wall surface of the cylinder block 10.

In another embodiment, the housing 100 may be integrally provided with an engine block. In this case, manufacturing time and manufacturing cost of the housing 100 of the EGR cooler 1 may be reduced due to a reduction in the number of assembling processes and a space in which the EGR cooler 1 is installed in an engine room of the vehicle may be minimized.

Here, the cooling fluid inlet 110 may be provided adjacent to the cylinder block 10, receive a coolant flowing inside the cylinder block 10 and, supply the received coolant to the inside of the housing 100, and the cooling fluid outlet 120 may be provided on an outer side of the cylinder block 10, i.e., adjacent to the tube plate 300 and the gas cover 400 to facilitate an adjustment of a diameter of a coolant outlet and change in design thereof. A specific configuration of the cooling fluid outlet 120 will be described with reference to the accompanying drawings. In another embodiment, the cooling fluid inlet 110 may be integrally provided with the cylinder block 10.

The gas tubes 200 are arranged in multiple steps and multiple rows and spaced apart from each other in a height direction to form an exhaust gas flow path in the housing 100. That is, an exhaust gas flows through the plurality of gas tubes 200 and is heat-exchanged with a cooling fluid present inside the housing so that the exhaust gas flowing inside is cooled.

As illustrated in FIGS. 1 to 3, the gas tube 200 of the vehicle EGR cooler 1 according to an embodiment of the present invention includes a first bent portion 220, a second bent portion 230, and a flat portion 210.

The flat portion 210 extends horizontally in a length direction of the housing 100. The first bent portion 220 is bent at one end of the flat portion 210 and the second bent portion 230 is bent at the other end of the flat portion 210.

Here, the second bent portion 230 opposes the first bent portion 220 and has the same length as that of the first bent portion 220. That is, the gas tube 200 may have a "C" shape overall.

In the gas tube 200, the first bent portion 220 and the second bent portion 230 may be bent to be rounded to have a predetermined curvature R at opposing ends of the flat portion 210.

Meanwhile, the tube plate 300, allowing opposing ends of the gas tubes 200 to be inserted thereto, includes tube insertion holes 310 corresponding to the number of the plurality of gas tubes 200.

In particular, the tube plate 300 includes a cooling fluid guide portion 320 whose inner surface at a position corresponding to the flat portion 210 of the gas tube 200 protrudes toward the flat portion 210, thus improving fluidity of the cooling fluid flowing into the housing 100.

In other words, without the cooling fluid guide portion 320, a portion of the cooling fluid inside the housing 100 may flow to a space between a tube located on the outermost portion adjacent to the tube plate 300, among the gas tubes 200, and an inner surface of the tube plate 300 and immediately flow out to the cooling fluid outlet 120, without heat-exchanging with the gas tube 200.

In order to prevent this, the cooling fluid guide portion 320 is provided between the gas tubes 200 and the tube plate 300 so that most of the cooling fluid flowing in through the cooling fluid inlet 110 flows along a path in which the gas tubes 200 are located and subsequently flows out to the cooling fluid outlet 120, thus improving fluidity of the cooling fluid.

The vehicle EGR cooler 1 according to the present invention further includes a gas cover 400 coupled to the housing 100 from an outer side of the tube plate 300 and having an exhaust gas inlet 410 provided on one side thereof in a length direction and an exhaust gas outlet 420 provided on the other side thereof.

Here, the exhaust gas inlet 410 and the exhaust gas outlet 420 may vary in angle according to application models, and the exhaust gas inlet 410 may be disposed on the same side as that of the cooling fluid inlet 110 of the housing 100 in the length direction or may be disposed on the opposite side in the length direction.

Figure 4:
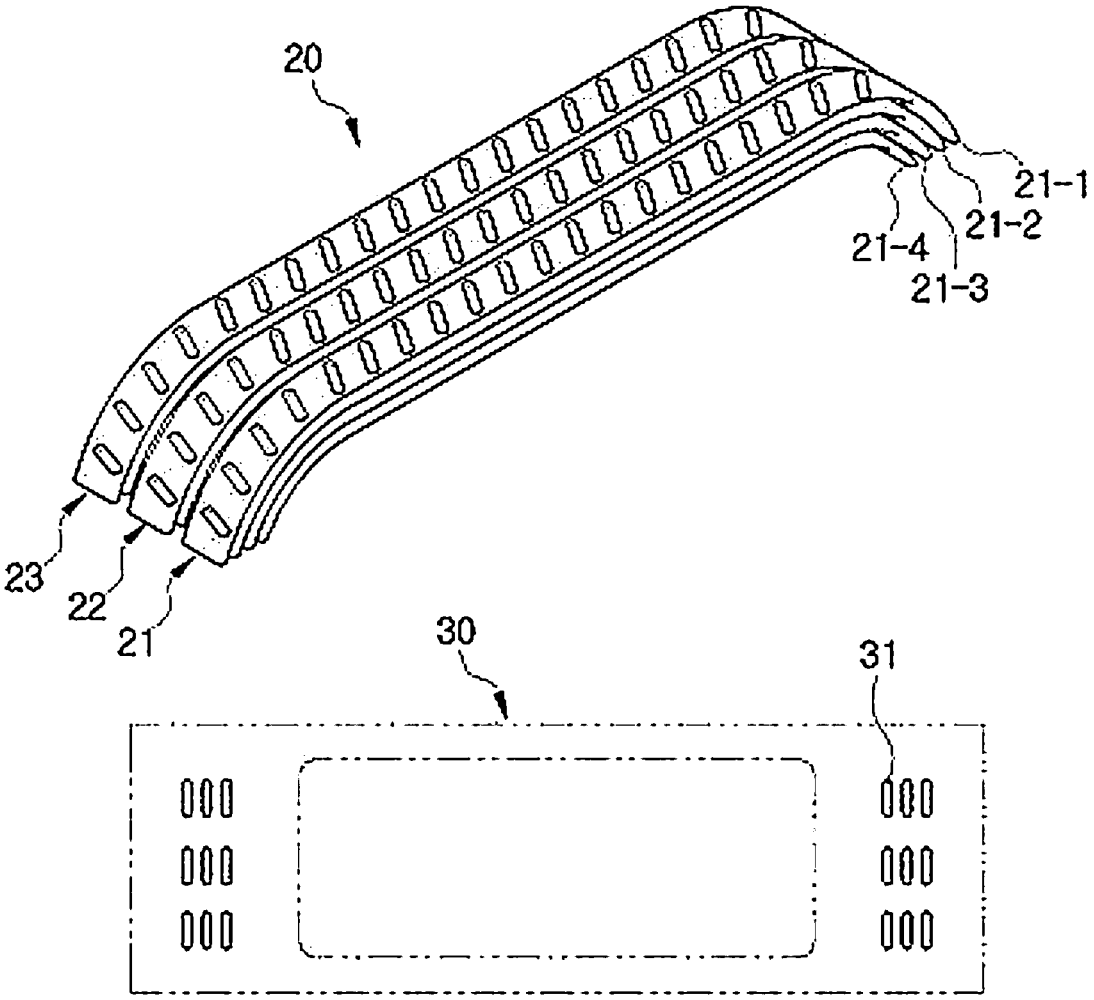
FIG. 4 is a perspective view of a gas tube arrangement of a general EGR cooler and a plan view of a tube plate to which a gas tube is coupled.

FIG. 4 is a perspective view illustrating an arrangement of a general gas tube 20 and a tube plate 30 to which the gas tube 20 is coupled. As illustrated, the general gas tube 20 is arranged in a three-row configuration including first to third row tubes 21, 22, and 23, and the first to third row tubes 21, 22, and 23 each include four tubes, i.e., (1-1)-th tube to (1-4)-th tubes 21-1, 21-2, 21-3, and 21-4, arranged in multiple steps to form rows.

The arrangement of the gas tubes 20 may be more easily understood in view of an arrangement of the tube insertion holes 31 of the tube plate 30 to which the gas tubes 20 are coupled. The tube insertion holes 31 are provided at opposing ends of the tube plate 30 so that one ends and the other ends of the gas tubes 20 are inserted thereinto, and positions of the tube insertion holes 31 may be determined depending on an arrangement of the gas tubes 20.

Hereinafter, the arrangement of gas tubes 200, 250 and 260 according to various embodiments of the present invention will be described in detail with reference to the accompanying drawings.

Figure 5:
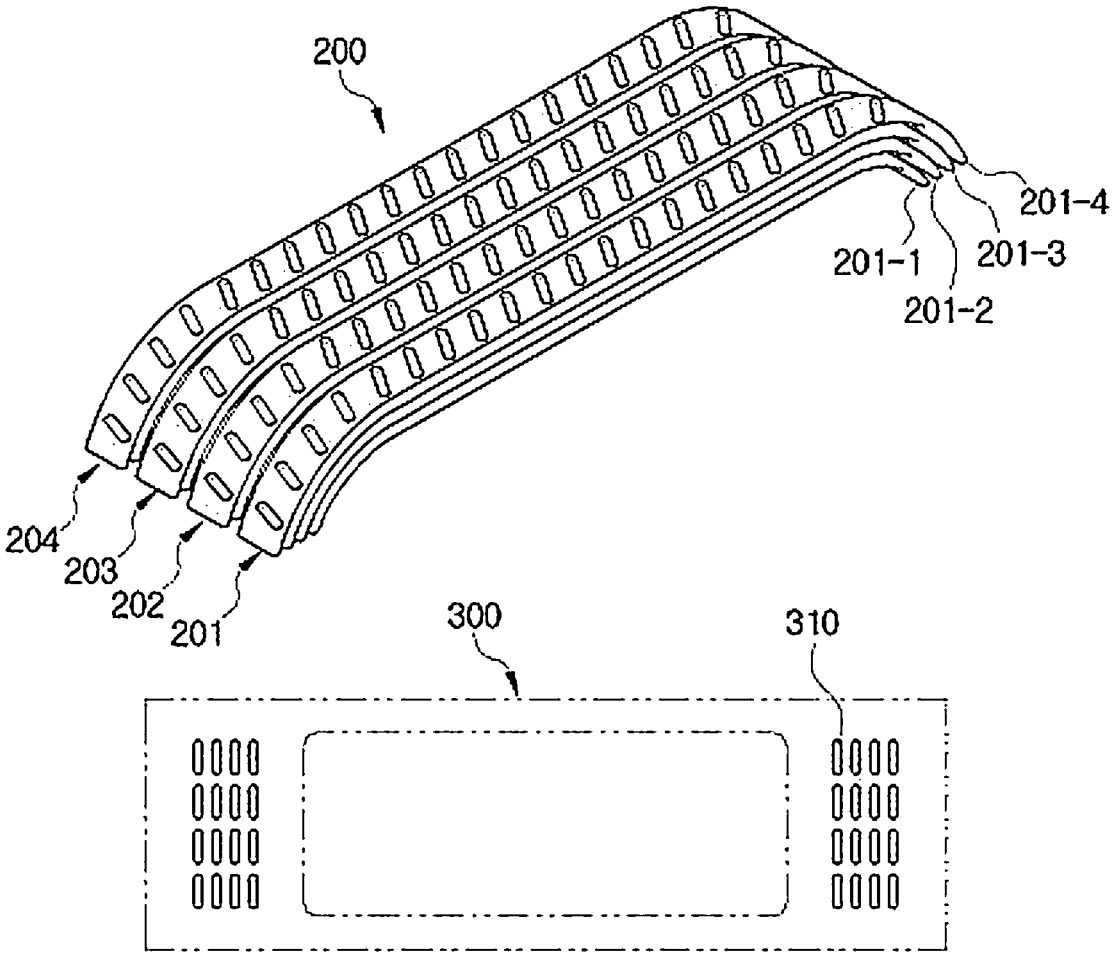
FIG. 5 is a perspective view of a gas tube arrangement and a plan view of a tube plate to which a gas tube is coupled according to a first embodiment of the present invention.
Figure 6:
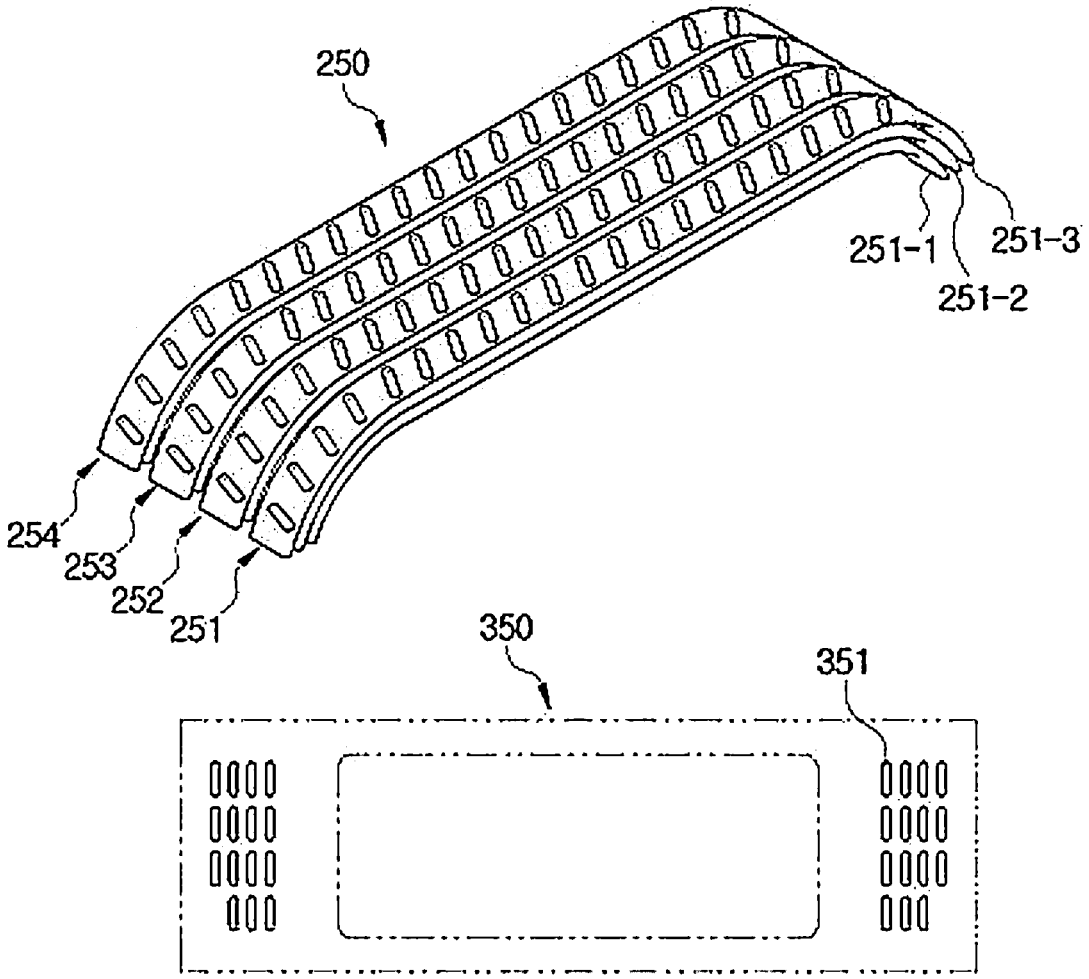
FIG. 6 is a perspective view of a gas tube arrangement and a plan view of a tube plate to which a gas tube is coupled according to a second embodiment of the present invention.
Figure 7:
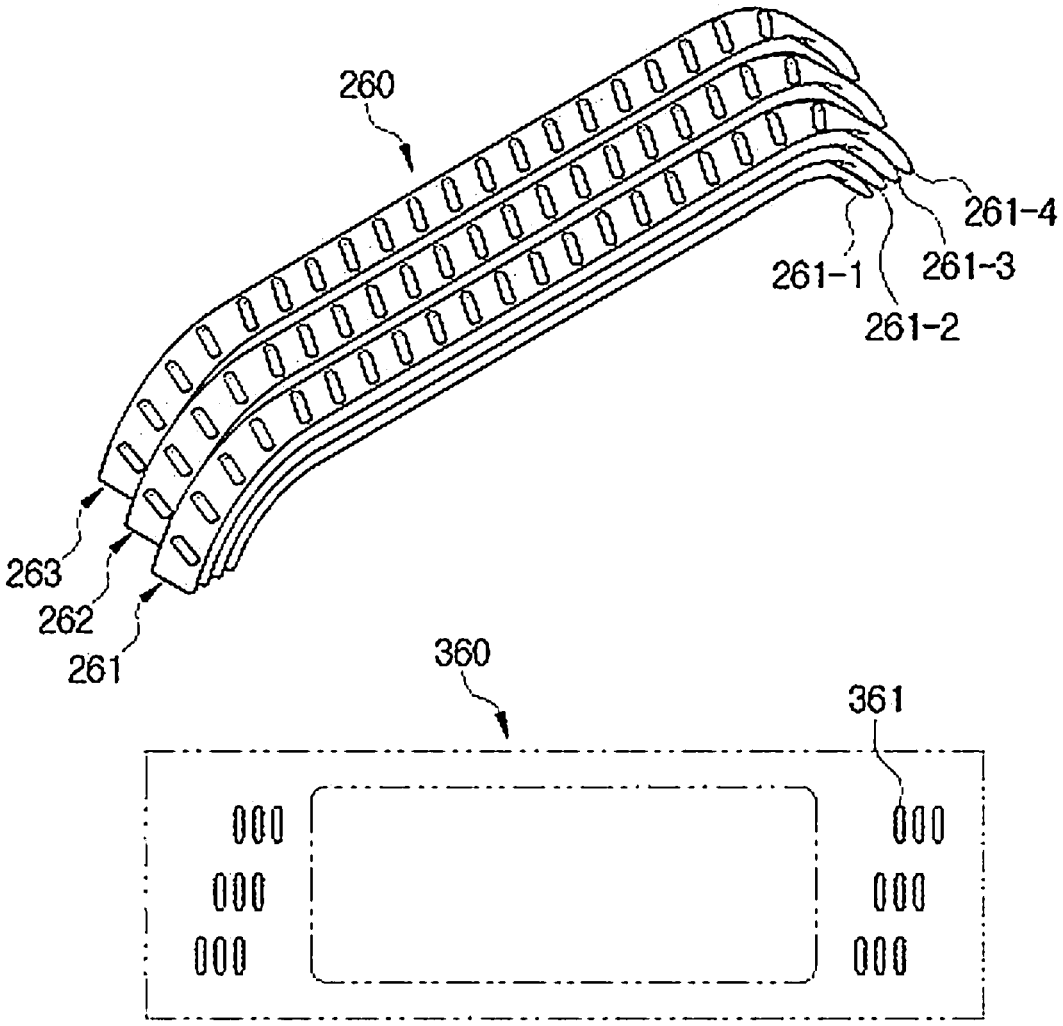
FIG. 7 is a perspective view of a gas tube arrangement and a plan view of a tube plate to which a gas tube is coupled according to a third embodiment of the present invention.

FIG. 5 is a perspective view illustrating an arrangement of a gas tube 200 and the tube plate 300 to which the gas tube 200 is coupled, FIG. 6 is a perspective view illustrating an arrangement of a gas tube 250 and the tube plate 350 to which the gas tube 250 is coupled, and FIG. 7 is a perspective view illustrating an arrangement of a gas tube 260 and a tube plate 360 to which the gas tube 260 is coupled.

Embodiment 1 (Thermally Expandable Type)

Referring to FIG. 5, the gas tube 200 according to the first embodiment of the present invention has one more row, as compared with the general gas tube 200 described above. That is, the gas tube 200 includes first to fourth row tubes 201, 202, 203, and 204 arranged in four rows, and the first to fourth row tubes 201, 202, 203, and 204 each include (1-1)-th to (1-4)-th tubes 201-1, 201-2, 201-3, and 201-4 in four steps forming one row.

The arrangement of the gas tubes 200 may be easily understood in view of the arrangement of the tube insertion holes 310 of the tube plate 300 to which the gas tubes 200 are coupled. The tube insertion holes 310 are provided at opposing ends of the tube plate 300 such that one end and the other end of the gas tube 200 are inserted thereinto and positions of the tube insertion holes 310 are determined depending on an arrangement of the gas tubes 200. The tube insertion holes 310 of this embodiment have a 4×4 form.

The arrangement of the gas tubes 200 as described above allows a larger amount of an exhaust gas to exchange heat with the cooling fluid, improving cooling performance of the exhaust gas.

Embodiment 2 (Flow Enhancement Type 1)

Referring to FIG. 6, the gas tube 250 according to the second embodiment of the present invention includes gas tubes 200 in which the gas tube 200 at the outermost row is deleted, as compared with the gas tubes 200 of the first embodiment. That is, the gas tubes 250 are arranged in four rows including first to fourth row tubes 251, 252, 253, and 254. The first to fourth row tubes 251, 252, 253, and 254 are configured such that four steps form one row, and the first row tube 251 is configured such that three steps such as (1-1)-th to (1-3)-th tubes 251-1, 251-2, and 251-3 form one row.

The arrangement of the gas tubes 250 may be easily understood in view of the arrangement of the tube insertion holes 351 of the tube plate 350 to which the gas tubes 250 are coupled. The tube insertion holes 351 are provided at opposing ends of the tube plate 300 such that one ends and the other ends of the gas tubes 200 are inserted thereinto and positions of the tube insertion holes 351 are determined depending on an arrangement of the gas tubes 250. The tube insertion holes 351 of this embodiment have a 4×3 and 3×1 form.

The arrangement of the gas tubes 250 as described above may prevent flow performance of the cooling fluid flowing inside the housing 100 from deteriorating as the number of the tube rows increases.

Embodiment 3 (Flow Enhancement Type 2)

Referring to FIG. 7, the gas tube 260 according to the third embodiment of the present invention includes rows arranged diagonally, as compared with the general gas tube 20. That is, the gas tubes 260 are arranged in three rows including first to third row tubes 261, 262, and 263. The first to third row tubes 261, 262, and 263 are configured such that four steps thereof form one row, and the first to third row tubes 261, 262, and 263 are disposed diagonally in a width direction of the tube plate 300.

The arrangement of the gas tubes 260 may be easily understood in view of the arrangement of the tube insertion holes 361 of the tube plate 360 to which the gas tubes 260 are coupled. The tube insertion holes 361 are provided at opposing ends of the tube plate 360 such that one ends and the other ends of the gas tubes 260 are inserted thereinto, and positions of the tube insertion holes 361 are determined depending on an arrangement of the gas tubes 260.

The arrangement of the gas tubes 260 as described above may prevent flow performance of the cooling fluid flowing between the densely arranged tubes from deteriorating.

Figure 8:
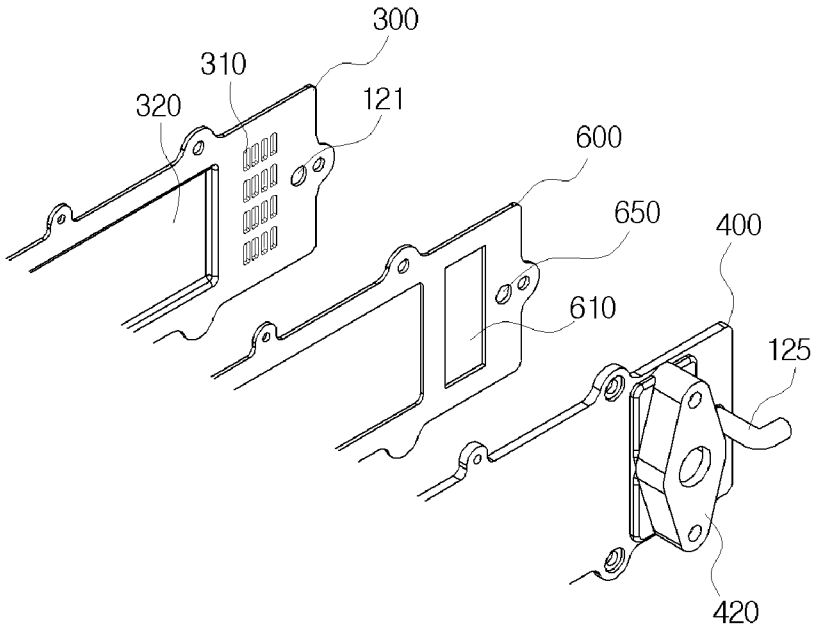
FIG. 8 is an enlarged partial exploded perspective view of an EGR cooler according to the present invention.
Figure 9:
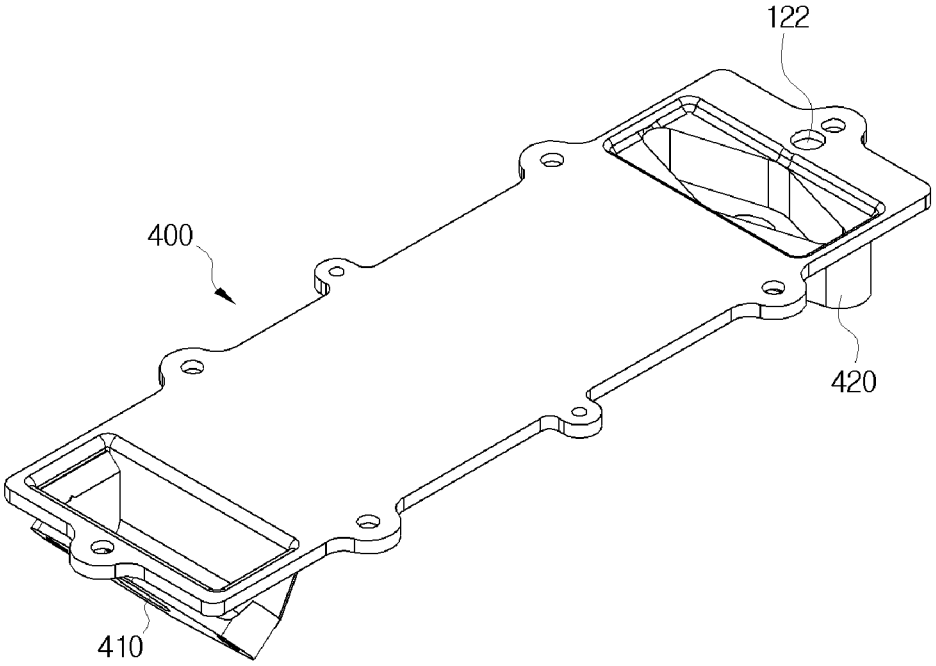
FIG. 9 is a perspective view of a side of a gas cover to which a housing is coupled according to an embodiment of the present invention.

FIG. 8 is an exploded perspective view of a coolant outlet 120 according to an embodiment of the present invention, and FIG. 9 is a perspective view of a side of the gas cover 400 to which the housing 100 is coupled according to an embodiment of the present invention.

The cooling fluid outlet 120, which is a characteristic component of the present invention, will be described in detail. As illustrated in FIGS. 1 to 5, the cooling fluid outlet 120 includes a first outlet hole 121, a second outlet hole 122, and a second outflow pipe 125.

As described above, the cooling fluid outlet 120 may be exposed to the outside of the cylinder block 10 through the tube plate 300 and the gas cover 400.

The first outlet hole 121 may be provided on the tube plate 300 and communicate with a space in which the coolant in the housing 100 flows, and the second outlet hole 122 may be provided on the gas cover 400 at a position corresponding to the first outlet hole 121 and communicate with the space in which the coolant in the housing 100 flows. In particular, the first and second outlet holes 121 and 122 may be provided close to the exhaust gas outlet 420 provided on the other side of the gas cover 400 in the length direction so that the coolant flowing in through the cooling fluid inlet 110 may be sufficiently heat-exchanged with the gas tube 200 and subsequently flows out through the first and second outlet holes 121 and 122. The outflow pipe 125 is configured such that one end thereof communicates with the second outlet hole 122 and the other side thereof is exposed to the outside of the gas cover 400.

Since the size of the first and second outlet holes 121 and 122 may be easily adjusted and the design of the outflow pipe 125 is not restricted through the above-described configuration, the diameter of the outlet and the design of the outflow pipe may be optimized for the flow of the coolant, and thus, the coolant may smoothly flow, improving heat exchange performance.

In addition, as illustrated in FIG. 2, the vehicle EGR cooler 1 according to an embodiment of the present invention may further include a gasket 500 and a sealing member 600.

The gasket 500 is installed between the housing 100 and the tube plate 300 to primarily prevent the cooling fluid from leaking from the housing 100 to the outside of the housing 100.

The gasket 500 may have a substantially rectangular plate shape, may correspond to a shape of an outer circumferential surface of the housing 100, and may be coupled to the housing 100 by a bolt.

The sealing member 600 is additionally provided between the tube plate 300 and the gas cover 400 to prevent an exhaust gas flowing in through the exhaust gas inlet 410 and an exhaust gas flowing out through the exhaust gas outlet 420 from leaking. Also, the sealing member 600 secondarily prevents a coolant from leaking to the outside of the housing 100 when the cooling fluid flows out through the cooling fluid outlet 120 from the housing 100. Thus, the sealing member 600 may include a pair of exhaust gas flow spaces 610 provided on an exhaust gas inlet and an exhaust gas outlet, respectively, and a cooling fluid flow space 650 provided adjacent to a cooling fluid outlet, and seal portions excluding the exhaust gas flow space 610 and the coolant flow space 650.

The sealing member 600 may correspond to a shape of an outer circumferential surface of the gas cover 400 and may be coupled by a bolt between the tube plate 300 and the gas cover 400, similarly to the gasket.

Here, in the vehicle EGR cooler of the present invention, the tube plate 300 and the gas cover 400 may be braze coupled without the sealing member 600.

The present invention should not be construed to being limited to the above-mentioned embodiment. The present invention may be applied to various fields and may be variously modified by those skilled in the art without departing from the scope of the present invention claimed in the claims. Therefore, it is obvious to those skilled in the art that these alterations and modifications fall in the scope of the present invention.

What is claimed is:

1. A vehicle exhaust gas recirculation cooler comprising:

a housing provided in a cylinder block located outside a water jacket of an internal combustion engine mounted in a vehicle and including a cooling fluid inlet and a cooling fluid outlet;

a plurality of gas tubes disposed inside the housing and configuring an exhaust gas flow path;

a tube plate including tube insertion holes to which opposing ends of the gas tubes are inserted and fixed; and a gas cover coupled to the housing on an outer side of the tube plate and including an exhaust gas inlet connected to one end of the gas tube and an exhaust gas outlet connected to the other end of the gas tube, wherein the cooling fluid inlet is provided adjacent to the cylinder block to receive a coolant flowing inside the cylinder block and supply the received coolant to the inside of the housing, and the cooling fluid outlet is provided on the gas cover and adjacent to the exhaust gas outlet, wherein the gas tube includes: a flat portion horizontally extending in a length direction of the housing; a first bent portion bent from one end of the flat portion to outside the housing; and a second bent portion bent from the other end of the flat portion to outside the housing, wherein the first and second bent portions are bent and rounded to have a predetermined curvature at opposing ends of the flat portion, wherein the tube plate includes a cooling fluid guide portion in which an inner side surface thereof at a portion corresponding to the flat portion protrudes toward the flat portion, wherein the cooling fluid guide part is formed such that a length thereof parallel to the tube plate is longer than a height thereof perpendicular to the tube plate, the height of the cooling fluid guide part being shorter than a distance between the tubes and the tube plate at an outermost position of the tubes toward the tube plate, further comprising:

a sealing member provided between the tube plate and the gas cover.

2. The vehicle exhaust gas recirculation cooler of claim 1, wherein the cooling fluid inlet is provided adjacent to the cylinder block, and the cooling fluid outlet is provided outside the cylinder block.

3. The vehicle exhaust gas recirculation cooler of claim 1, wherein the cooling fluid outlet is provided outside the cylinder block through the tube plate and the gas cover.

4. The vehicle exhaust gas recirculation cooler of claim 3, wherein the cooling fluid outlet includes:

a first outlet provided at the tube plate;

a second outlet provided at the gas cover to correspond to the first outlet hole; and an outflow pipe having one end connected to the second outlet hole.

5. The vehicle exhaust gas recirculation cooler of claim 4, wherein the first and second outlet holes are provided close to any one of the tube insertion holes.

6. The vehicle exhaust gas recirculation cooler of claim 4, wherein the first and second outlet holes exhaust gas recirculation are provided close to the exhaust gas outlet.

7. The vehicle exhaust gas recirculation cooler of claim 1, wherein the gas tube includes a plurality of rows arranged and spaced apart from each other in a width direction of the tube plate, and the tube of each row has multiple steps.

8. The vehicle exhaust gas recirculation cooler of claim 7, wherein the gas tube is configured such that the number of steps of the tubes in at least one row disposed on an outermost side is smaller than the number of steps of the tubes in a neighboring row.

9. The vehicle exhaust gas recirculation cooler of claim 1, wherein the gas tube is configured such that a plurality of rows are arranged and spaced apart from each other in a width direction of the tube plate and diagonally arranged in the width direction of the tube plate.

10. The vehicle exhaust gas recirculation cooler of claim 1, wherein the sealing member is provided between the tube plate in which the first and second outlet holes and the tube insertion holes are provided and the gas cover.

11. The vehicle exhaust gas recirculation cooler of claim 1, wherein the tube plate, the sealing member, and the gas cover are coupled by a bolt.

12. The vehicle exhaust gas recirculation cooler of claim 1, wherein the tube plate and the gas cover are braze coupled.

13. The vehicle exhaust gas recirculation cooler of claim 1, wherein the housing is arranged to be in contact with an outer wall surface of the cylinder block or is integrally provided with the cylinder block.

* * * * *